US005083895A

United States Patent [19]

McBirnie

[11] Patent Number: 5,083,895

[45] Date of Patent: Jan. 28, 1992

[54] STACKING DEVICE FOR MINE CRIBBING

[75] Inventor: Carl McBirnie, Salt Lake County, Utah

[73] Assignee: Commercial Pantex Sika, Inc., Youngtown, Ohio

[21] Appl. No.: 306,484

[22] Filed: Feb. 6, 1989

[51] Int. Cl.[5] ..... B66C 1/68

[52] U.S. Cl. ..... 414/739; 414/728

[58] Field of Search ..... 414/700, 739, 718, 728; 901/1; 294/86.41, 88, 68.23

[56] References Cited

U.S. PATENT DOCUMENTS

| | | | |
|---|---|---|---|
| 513,948 | 1/1895 | Judd et al. . | |
| 1,993,754 | 11/1931 | Smith et al. | 29/60 |
| 2,782,942 | 2/1957 | Scott | 214/6 |
| 2,886,194 | 5/1959 | Codlin | 214/147 |
| 3,247,987 | 4/1966 | Lake | 414/739 |
| 3,260,391 | 7/1966 | Horton | 214/650 |
| 3,713,557 | 1/1973 | Seaberg et al. | 414/700 |
| 3,830,382 | 8/1974 | Nagamori | 214/1 |
| 4,029,230 | 6/1977 | Bolduc et al. | 214/654 |
| 4,074,819 | 2/1978 | Labourre | 214/83.1 |
| 4,132,318 | 1/1979 | Wang et al. | 414/739 X |
| 4,314,471 | 2/1982 | Lukach | 72/270 |
| 4,451,194 | 5/1984 | Keats et al. | 294/86.41 X |
| 4,676,713 | 6/1987 | Voelpel | 901/1 X |

*Primary Examiner*—Robert J. Spar
*Assistant Examiner*—Donald W. Underwood
*Attorney, Agent, or Firm*—Buchanan Ingersoll; Lynn J. Alstadt

[57] ABSTRACT

A stacking apparatus of the type which can be connected to a vehicle having a hydraulic system is disclosed comprising a base, a telescope arm support pivotably attached to the base in a manner to allow 360° rotation of the telescoping arm support, and a telescope arm pivotably attached at one end to the telescope arm support in a manner to allow vertical movement of an opposite end of the arm. A load gripping mechanism having at least two gripping plates is attached to the opposite end of the telescope arm. First hydraulic structure are attached to the gripping plates for moving the plates together to grasp an object and for moving the plates apart to release the object and attachment structure are provided for pivotably attaching the support plates to the telescope arm in a manner to permit pivotable movement of the plates in first and second vertical planes which intersect at right angles. Second and third hydraulic structure are attached to the attachment structure for pivoting the gripping plates along the two vertical planes. All hydraulic structure can be connected to the vehicle's hydraulic system.

9 Claims, 3 Drawing Sheets

STACKING DEVICE FOR MINE CRIBBING

The present invention relates to hydraulic devices for gripping objects particularly donut mine cribbing, lifting them from one location, and placing or stacking the objects in another location.

DESCRIPTION OF THE PRIOR ART

Many devices have been developed for grasping objects and lifting them from one location and placing the objects in another location. Some of these devices are designed to be attached to fork lift trucks and handle large heavy objects. Others are intended to carry out repetitive workpiece handling in a manufacturing environment. This later group of devices, sometimes called industrial robots, generally operate from a fixed position in an assembly line or connected to certain machinery.

In underground mines it is necessary to support portions of the roof of the mine from collapse after coal has been removed. Commonly, wood cribbing has been used to provide such support. In recent years, precast concrete blocks such as the cylindrical donut cribbing disclosed in U.S. Pat. No. 4,565,469 have been used to make mine roof supports. Both cribbing techniques involve stacking units of cribbing on top of one another to create a support structure which runs from the mine floor to the mine roof Depending upon the height of the coal seam these support structures can range from three to twelve feet high. Prior to the present invention the construction of these structures required crews of several men. Additionally, scaffolding had to be constructed to build supports higher than about seven feet.

In most underground mines it is necessary to construct at least two separate tunnels to the area where coal is being mined. In each tunnel support structures or cribbing must be built about every five to twelve feet. Therefore, mining companies have crews which work all day building roof supports. Typically, a nine man crew can build about 15 wood crib supports and a three men crew can build about 20 donut cribbing supports in an eight hour shift. Consequently, there is a need for a mechanical crib stacking device which can be used in the mines and improve productivity.

Prior to the present invention, mechanical crib stacking devices have not been used in underground mines. The industrial robots are not suitable because they are stationery and not constructed to handle heavy loads. Moreover, many of them have electrical power requirements unsuitable for mine environments. Gripping devices which can be attached to fork lift trucks as well as grab trucks are too large for most mines. Additionally, most of these devices are not able to manipulate cribbing in a confined mine to make stacks of cribbing. Consequently, there is a need for a compact stacking device which can be used in an underground mine to stack cribbing for mine roof supports.

SUMMARY OF THE INVENTION

I provide a compact stacking device which is particularly suited to stack cribbing in an underground mine. My stacking device has a base which can be carried by or attached to most mining vehicles such as a truck or mining machine. A telescoping arm is pivotably attached to a support rotatably mounted on the base. A load gripping mechanism is pivotably attached to the distal end of the arm. I prefer to provide a gripping mechanism with two plates positioned adjacent to one another. First hydraulic means are provided for moving the plates together to grip an object and apart to release the object. Attachment means are provided to connect the plates to the telescoping arm in a manner to permit pivotal movement of the plates in two vertical planes which intersect at right angles. Hydraulic means are provided to pivot the plates through these planes which allows grasped objects to be kept level. Finally, connectors are provided to attach all hydraulic means to the hydraulic system of an auxiliary vehicle such as a truck or mining machine.

I prefer to provide an optional automatic leveling device which senses the position of objects being grasped and activates hydraulic means as required to keep the object level.

I also prefer to provide a remote control unit to enable the operator to use my device while standing some distance away from the device. Preferably the remote control will use not more than 1.5 volts.

Other objects and advantages of the invention will become more fully apparent from the following detailed description of certain present preferred embodiments of the invention shown in the accompanying drawings.

DESCRIPTION OF THE PREFERRED EMBODIMENTS

Figure 1:
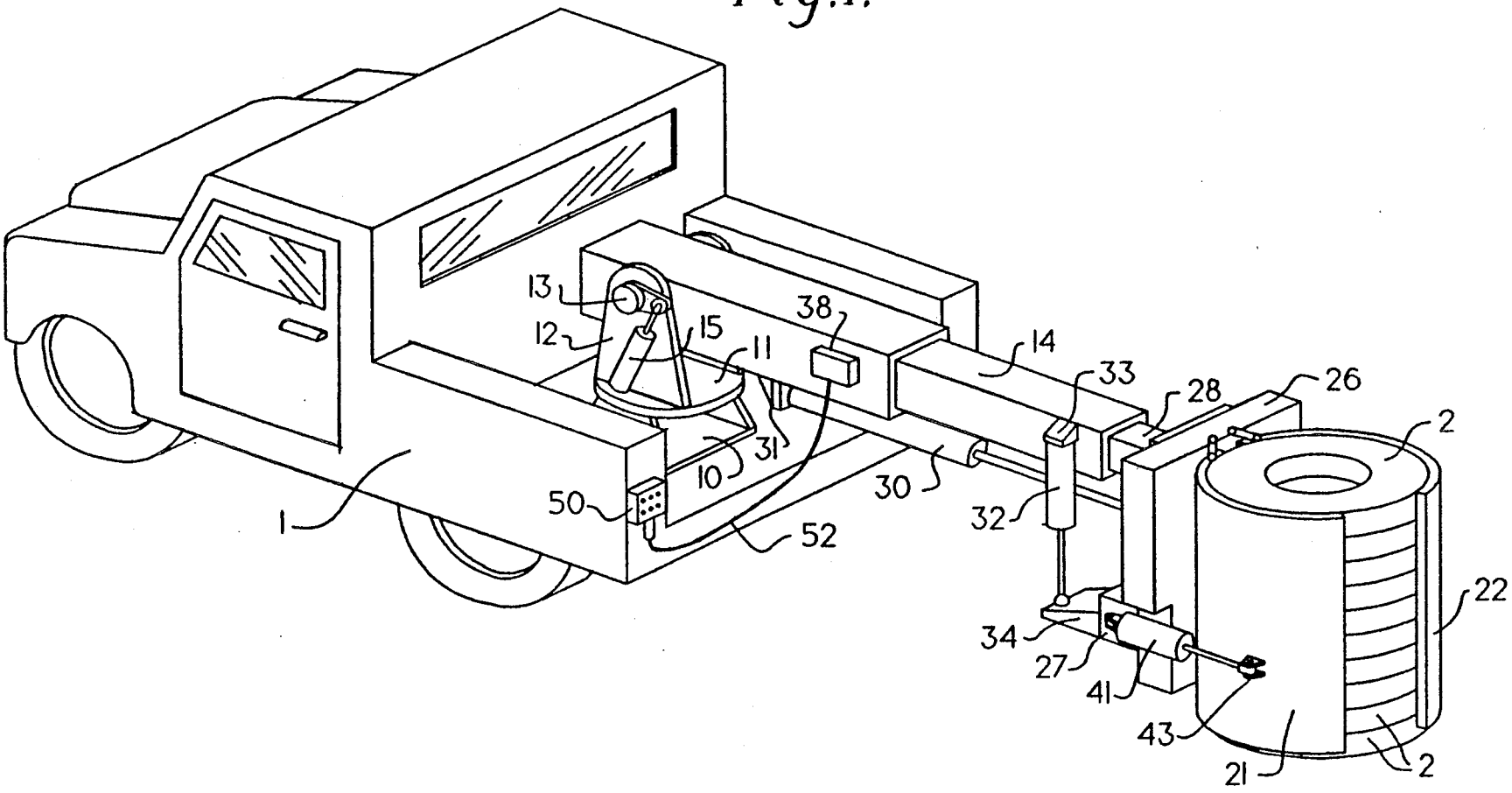
FIG. 1 is a perspective view of my stacking device mounted on a truck bed and holding donut cribbing.

As shown in FIG. 1, I provide a base 10 which can be bolted to a truck 1 or other mine vehicle. Base 10 holds a rotatable support 12 for telescoping arm 14. I prefer to provide a rotating pedestal 11 which allows arm 14 to be rotated 360°. Movement is provided by an arm swivel motor 6 within pedestal 11. Arm 14 is pivotably attached to support 12 through pin 13. I prefer to provide at least one hydraulic cylinder 15 connected between arm 14 and support 12 for raising and lowering arm 14. Another hydraulic arm extend cylinder 8 is provided within arm 14.

These arm lift and arm extend cylinders are controlled by solenoids 38 preferably mounted on arm 14. The solenoids are connected to the vehicle's hydraulic system which serves as the power source. Those skilled in the art will recognize that the structure which I have described to this point is commonly used in cranes. Indeed, I have been able to use parts from small cranes for this portion of my device.

Figure 2:
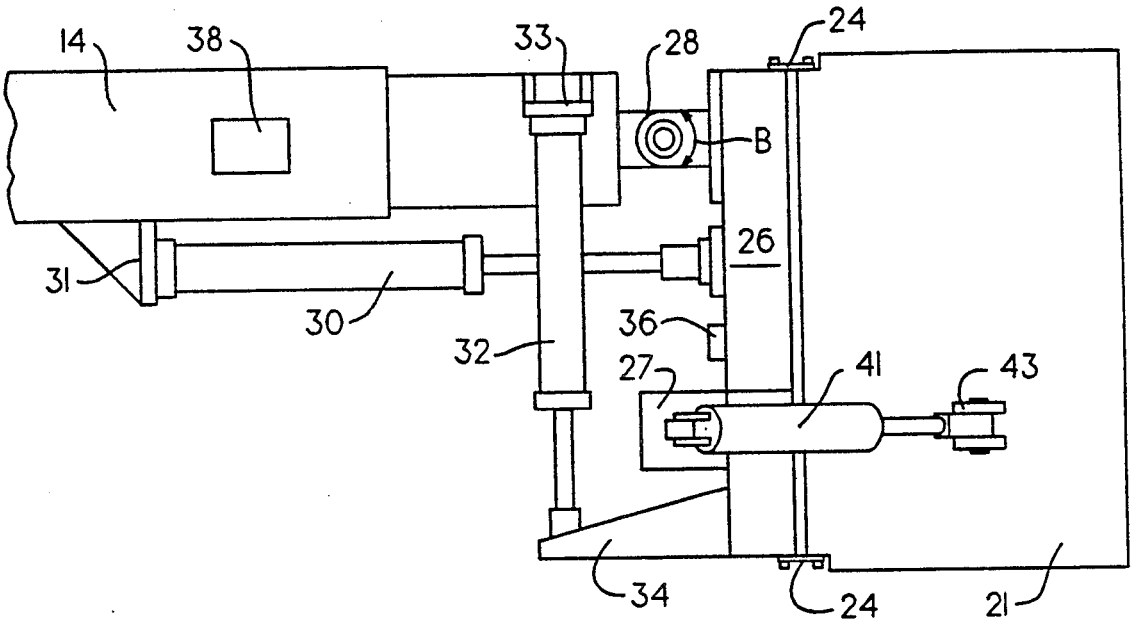
FIG. 2 is a side view of the load gripping portion of the embodiment of FIG. 1.
Figure 3:
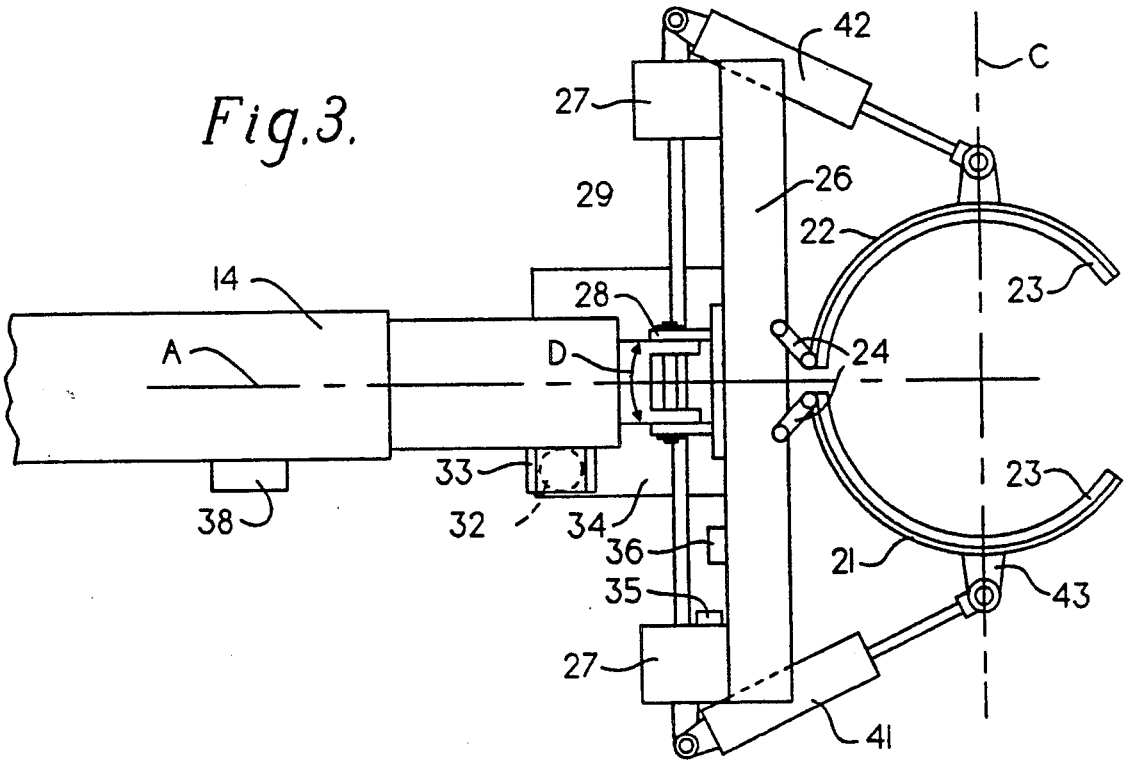
FIG. 3 is a top view of the load gripping portion of the embodiment of FIG. 1.

A load gripping mechanism is pivotably attached to the distal end of arm 14. I prefer to provide two curved plates 21 and 22 preferably lined with vulcanized rubber 23 to provide a surface with high friction. This surface assists in gripping and stabilizing the stack of donut cribbing 2 within the plates 21 and 22. A piano type hinge 24 connects each plate 21 and 22 to support 26. Support 26 is pivotably connected to the distal end of arm 14 by universal joint 28. Such an attachment permits plates 21 and 22 to be pivoted through a first plane that runs longitudinally through arm 14. Additionally, plates 21 and 22 can be pivoted through a second vertical plane which intersects the first plane at a right angle. To control movement of the plates through the first vertical plane, i.e., movement through a plane A extending along the longitudinal axis of the arm and about an axis as shown by arrow B in FIG. 2, I provide a first hydraulic cylinder 30. A support 31 extends from arm 14 to hold one end of hydraulic cylinder 30. The opposite end of hydraulic cylinder 30 is connected to support 26. I also prefer to provide a second hydraulic cylinder 32 to control horizontal movement, i.e., movement through a plane C extending transverse the gripping plates and about an axis as shown by arrow D in FIG. 3. This cylinder 32 extends down from support 33 mounted on one side of arm 14 to a foot 34 which extends from the bottom of support 26. Because this cylinder 32 is attached to one side of an arm 14 it can control horizontal level of the grab plates 21 and 22.

Plates 21 and 22 are positioned so that their top edge does not extend substantially above the top of the telescoping arm 14. Such an alignment, as can be clearly seen in FIG. 2, allows the operator to stack cribbing to the roof of a coal mine.

To open and close plates 21 and 22 I provide a pair of hydraulic cylinders 41 and 42 which extend from mounts 43 and 44 on the back of plates 21 and 22. The hydraulic cylinders are also connected to beams 27 which are attached to support 26 and reinforced by rod 29.

Figure 4:
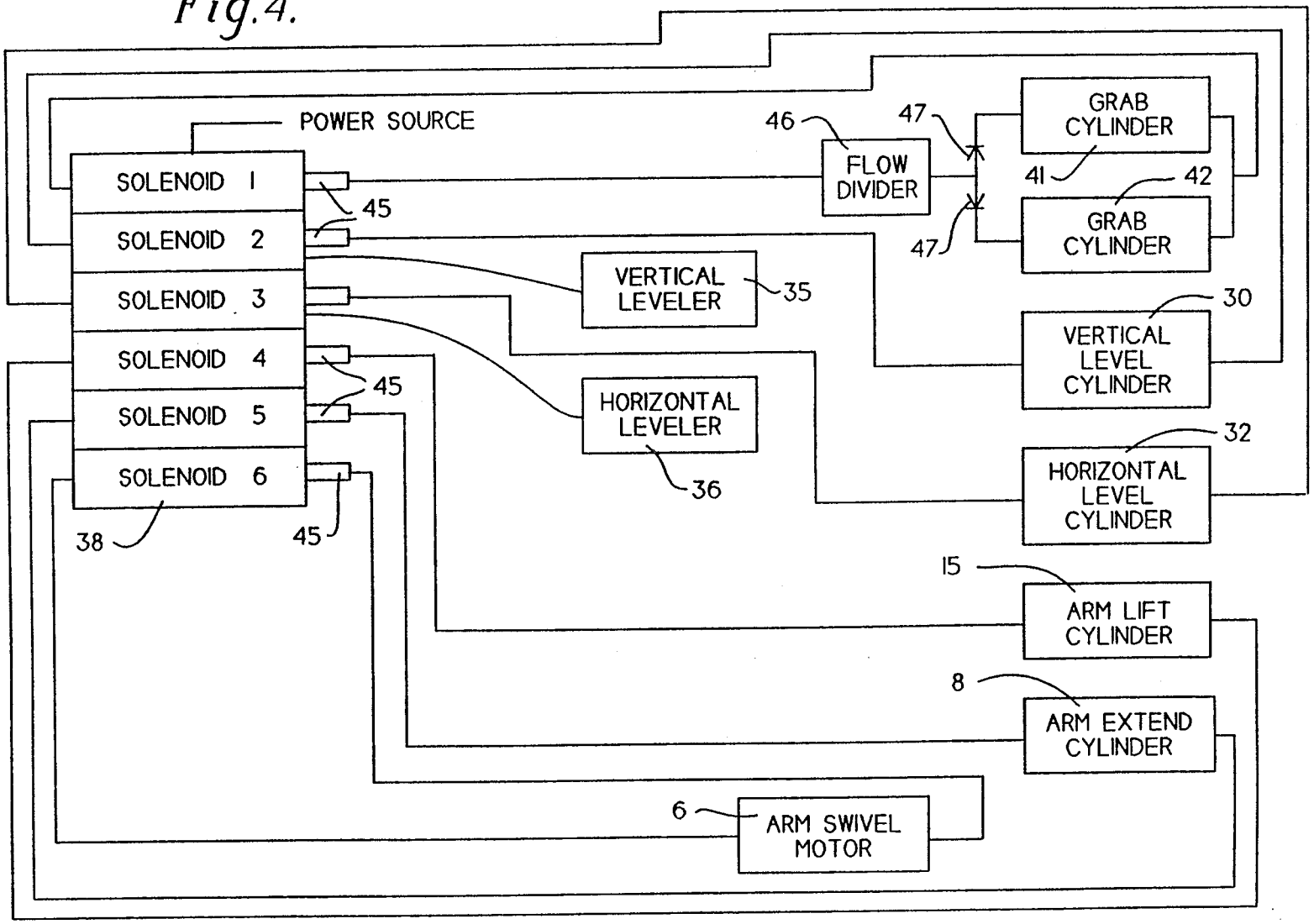
FIG. 4 is a circuit diagram of a preferred hydraulic circuit for my stacking device.

As shown in FIG. 4, hydraulic lines run from hydraulic cylinders 12, 30, 32, 41 and 42 to a series of solenoid valves 44 and flow control valves 45 which connect through a main line to a power source. Preferably, the hydraulic system of an auxiliary vehicle such as a truck 1 will be the power source. For ease of understanding the hydraulic lines have been omitted from FIGS. 1, 2 and 3. I prefer to provide a flow divider 43 and check valves 47 in the line to grab cylinders 41 and 42. This assures that pressure to both cylinders will be the same. Equal pressure and flow will cause plates 21 and 22 to move at the same rate.

I also prefer to provide automatic levelers 35 and 36 to control the leveling cylinders 30 and 32. These levelers can be mounted on support 26 in a manner to enable them to sense the horizontal and vertical tilt of the grab plates 21 and 22. I have found that the ACW112A,D Level Controller manufactured by Sundstrand Sauer is a suitable automatic leveler for my device. For each leveler I prefer to provide an on/off switch (not shown). When the levelers are off the operator can control the horizontal and vertical tilt. Such control is usually desired when picking up objects from a mine floor because mine floors are seldom level. However, during transport and stacking of the objects it is best to have a level load. This is important because the mine cribs must be horizontally and vertically level when stacked. Keeping the load level also allows one to place the wood cap required between the crib stack and mine roof on the last load of cribbing. That eliminates the need to carry the cap up a ladder to the top of the crib stack. The automatic levelers can constantly monitor the position of the load as it is moved over an uneven floor. The levelers will activate cylinders 30 and 32 as necessary to keep the load level.

I prefer to provide a remote control unit 50 to operate valves 44 and levelers 35 and 36. The remote control unit 50 is connected to valves 44, and levelers 35 and 36 through a multiple wire cable 52. Only 1.5 volts are needed to power controller 50. Consequently, my device meets power restrictions for underground mine devices.

To operate my device, truck 1 moves to a position between cribbing stacked on a pallet and a roof support being constructed. Remote control unit 50 enables the operator to stand near the roof support Without moving the truck 1 the operator can turn off the automatic levelers 35 and 36, extend arm 14 and manipulate grab plates 21 and 22 to grasp a stack of donut cribbing 2. Then, he activates the automatic levelers 35 and 36 and rotates, pivots and extends arm 14 to place the stack of cribbing on a roof support being constructed. Arm 14 is long enough to stack cribbing from floor to roof in the mine. Consequently, one operator using my device can build a roof support in less time than could a three man crew. Scaffolding is never required when my stacker is used. After one support is built my stacker is moved by truck 1 into position to build the next support. Often the truck 1 can be positioned so that two or more supports can be built in the desired locations without moving the truck.

Although I have described and shown certain present preferred embodiments of my stacker, it should be distinctly understood that my invention is not limited thereto, but may be variously embodied within the scope of the following claims.

I claim:

1. A stacking apparatus for use in underground mines and other confined spaces of the type which can be connected to a vehicle having a hydraulic system comprising:

a) a base;

b) a telescoping arm support pivotably attached to the base in a manner to allow 360° rotation of the telescoping arm support;

c) a telescoping arm pivotably attached at one end to the telescoping arm support in a manner to allow vertical movement of an opposite end of the arm;

d) arm hydraulic means connected between the telescoping arm and one of the base and the telescoping arm support to provide forward and backward telescoping movement and up and down movement of the telescoping arm;

e) a load gripping mechanism attached to the opposite end of the telescoping arm comprising:

i) at least two gripping plates positioned adjacent one another each plate having a top edge aligned with the telescoping arm;

ii) first hydraulic means attached to the gripping plates for moving the plates together to grasp an object and for moving the plates apart to release the object;

iii) attachment means for pivotably attaching the gripping plates to the telescoping arm in a manner to permit pivotable movement of the plates in first and second vertical planes which intersect at right angles, the first vertical plane extending along the longitudinal axis of the arm and the second vertical plane extending transverse to the gripping plates;

iv) second hydraulic means attached to the attachment means for pivoting the gripping plates along the first vertical plane;

v) third hydraulic means attached to the attachment means for pivoting the gripping plates along the second vertical plane, and vi) connectors attached to all hydraulic means for connecting all hydraulic means to the vehicle hydraulic system.

2. The stacking apparatus of claim 1 also comprising automatic leveling means connected to the second hydraulic means and the third hydraulic means.

3. The stacking apparatus of claim 1 wherein the second hydraulic means is also connected to the telescoping arm.

4. The stacking apparatus of claim 1 also comprising a controller and at least one wire connecting the controller to all hydraulic means in a manner to permit activation of the hydraulic means by the controller.

5. The stacking apparatus of claim 4 wherein the controller is constructed to operate on not more than 1.5 volts.

6. The stacking apparatus of claim 4 wherein the wire is of sufficient length to allow an operator to use the controller while standing at a location where articles are to be placed by the apparatus.

7. The stacking apparatus of claim 4 also comprising automatic leveling means connected to the second hydraulic means and the third hydraulic means and at least one wire connected between the controller and the automatic leveling means to enable an operator to turn the automatic leveling means on and off.

8. The stacking apparatus of claim 1 also comprising resilient means attached to each gripping plate in a manner to form a gripping surface.

9. The stacking apparatus of claim 1 wherein the gripping plates are curved in a manner to permit gripping of cylindrical objects.

* * * * *

UNITED STATES PATENT AND TRADEMARK OFFICE

CERTIFICATE OF CORRECTION

PATENT NO. : 5,083,895

DATED : January 28, 1992

INVENTOR(S) : CARL MCBIRNIE

It is certified that error appears in the above-identified patent and that said Letters Patent is hereby corrected as shown below:

Column 1, line 29, after "roof" insert --.--.

Column 3, line 30, change "12" to --15--.

Column 3, line 31, change "44" to --38--.

Column 3, line 36, change "43" to --46--.

Column 3, line 65, change "44" to --38--.

Column 3, line 66, change "44" to --38--.

Signed and Sealed this

Twenty-fifth Day of May, 1993

*Attest:*

Michael K. Kirk

MICHAEL K. KIRK

*Attesting Officer*

*Acting Commissioner of Patents and Trademarks*